United States Patent [19]

Iwata et al.

[11] Patent Number: 4,648,209

[45] Date of Patent: Mar. 10, 1987

[54] SMALL-SIZED DRILL GRINDING MACHINE

[75] Inventors: Kazuyoshi Iwata, Nagoya; Kazuo Fujii, Aichi, both of Japan

[73] Assignee: Toyo Machinery Co., Ltd., Aichi, Japan

[21] Appl. No.: 790,478

[22] Filed: Oct. 23, 1985

[30] Foreign Application Priority Data

Apr. 2, 1985 [JP] Japan ..... 60-69597

[51] Int. Cl.[4] ..... B24B 3/00; B24B 5/00

[52] U.S. Cl. ..... 51/90; 51/219 R; 51/98 R; 51/101 R

[58] Field of Search ..... 51/127, 101 R, 219 R, 51/90, 120, 34 K, 43

[56] References Cited

U.S. PATENT DOCUMENTS 3,224,146 12/1965 Ahlström ..... 51/90
3,274,736 9/1966 Brokaw ..... 51/127
3,822,511 7/1974 Hoglund ..... 51/101 R

FOREIGN PATENT DOCUMENTS 5347275 1/1976 Japan .

*Primary Examiner*—Robert P. Olszewski
*Assistant Examiner*—Maurina Rachuba
*Attorney, Agent, or Firm*—Browdy and Neimark

[57] ABSTRACT

A drill grinding machine of bench type wherein a drill can be ground by a required amount automatically and accurately. The grinding machine comprises a rotor installed adjacent to a turntable, first and second transmission shafts connected to each other so that they cannot be rotated relative to each other but so that they can be moved relative to each other axially, and a grinding wheel drive lever with one end threadedly coupled to the first transmission shaft. The rotor is rotated by a prescribed amount for each revolution of the turntable. The rotational movement of the rotor is converted into the rotational movement of the second and first transmission shafts, and is then converted into rotational movement of the grinding wheel drive lever, whereby the grinding wheel is displaced to effectively provide drill infeed and the depth setting for sharpening of the next revolution the drill is automatically increased.

15 Claims, 13 Drawing Figures

SMALL-SIZED DRILL GRINDING MACHINE

BACKGROUND OF THE INVENTION

The present invention relates to bench drill grinding machines of small size, and more specifically to a drill grinding machine which can be used in various machine manufacturing fields such as industrial machine manufacturing, welfare machine manufacturing, household electric machine manufacturing, electric machine manufacturing, automobile manufacturing, building material manufacturing and the like.

As an example of such small-sized drill grinding machine in the prior art, a drill grinding machine disclosed in Japanese utility model application (publication No. 53-47) is known.

The drill grinding machine comprises (a) a casing;

(b) a turn table having a drill attaching hole at the center and supported by the casing and rotatable around a first axial center passing through the drill attaching hole;

(c) a table drive device for driving the turntable to rotate;

(d) a chuck device having pawls provided at the center of the turn table and movable perpendicularly direction to the first axial center, for grasping the drill using the pawl so that the axial center of the drill coincides with the first axial center;

(e) a grinding wheel being rotatable in parallel to the first axial center that is and around a second axial center shifted in the perpendicular direction to the first axial center, for grinding a cutting edge at the top end of the drill rotating together with the turn table;

(f) a grinding wheel drive device for driving the grinding wheel to rotate;

(g) a grinding wheel support device provided with a first support member to rotatably support the grinding wheel, a second support member to support the first support member and being movable relative to said first support member in the extending direction of (parallel to) the second axial center; and a third support member to support the second support member and being movable relative to said second support member perpendicularly to the second axial center, for supporting the grinding wheel, the grinding wheel being accordingly movable perpendicularly to a direction parallel to the drill axial center;

(h) a grinding wheel drive lever installed near the grinding wheel support device and being rotatable around a third axial center that is perpendicular to the second axial center a one end thereof being engaged with the second support member, and threaded end -O- having a threaded portion;

(i) a first transmission shaft threadedly engaged with the threaded portion of the grinding wheel drive lever;

(j) a second transmission shaft connected to the first transmission shaft so that it cannot be rotated relative to said first transmission shaft but can be moved relative to said first transmission shaft in the axial direction thereof;

(k) first and second cams installed on outer circumferential part of the turntable;

(l) a first grinding wheel moving mechanism having a first follower to follow the first cam, for converting the movement of the first follower into movement of the first transmission shaft in its axial direction, for rotating the grinding wheel drive lever, and for accordingly moving the grinding wheel forward and backward in the drill axial direction as a result of contact of said one end of the lever with the second support member; and (m) a second grinding wheel moving mechanism having a second follower to follow the second cam, for converting the movement of the second follower into movement of the second support member perpendicularly to the second axial center, is that the grinding wheel is moved forward and backward perpendicularly to the drill axial center.

In the drill grinding machine, if the drill to be reground is grasped by the chuck device and the turntable and the grinding wheel are driven to rotate, the grinding wheel is reciprocated in the drill axial direction and perpendicularly thereto according to a definite locus specified by the contours of the first and second cams during each revolution of the drill and turn table, and thereby the re-grinding and the thinning of the drill cutting edge are performed simultaneously.

However, in the drill grinding machine, the grinding wheel is returned to the initial position after one revolution of the drill and the turntable. Consequently, in order to perform the infeed of the drill cutting edge more deeply, the position of the grinding wheel must be displaced by adjustment of its infeed, for example, by rotating an operation handle of a grinding wheel displacement device to displace the position of the grinding wheel in parallel to the drill axial center. Accordingly, the drill grinding machine has problems in that the grinding work is not so easy.

SUMMARY OF THE INVENTION

An object of the invention is to provide a small-sized drill grinding machine, wherein the position of a grinding wheel is automatically displaced to provide infeed predetermined during each revolution of the drill, thereby eliminating the operation of manually correcting the infeed position of the infeed grinding wheel, such that a person who is not a skilled worker can grind the drill easily and simply.

The object of the invention can be attained by a drill grinding machine which is provided with, in addition to the elements of the conventional grinding machine (n) an intermittent rotation mechanism having a rotor installed near the turntable and an engaging piece provided on the turntable to rotate integrally therewith, so that the engaging piece rotates with each the rotor by a certain amount with each revolution of the turntable, based on the engagement of the engaging piece with the rotor;

(o) a grinding wheel displacement mechanism for converting the rotational movement of the rotor into rotational movement of the second transmission shaft thereby, rotating the grinding wheel drive lever which is threadedly engaged with the first transmission shaft, to displace the grinding wheel in parallel to the drill axial center which is the same as the drill infeed direction; and (p) a grinding wheel displacement amount detecting device for detecting the amount of displacement of the grinding wheel.

That is, in the drill grinding machine of the invention, the rotor is rotated intermittently during each revolution of the drill on the turn table, and the rotational movement of the rotor is transmitted by rotational movement of the second transmission shaft and the first transmission shaft so that the grinding wheel is automatically transferred (displaced) to move to effectively provide drill infeed. Accordingly, the worker need not correct the position of the grinding wheel in correspondence to angle of the cutting edge on the top end of the drill, but instead he need only stop the grinding action of the grinding wheel when the grinding wheel is automatically displaced by a prescribed amount.

This stopping operation can be performed also by a control device provided on the drill grinding machine according to the present invention.

Although the small-sized drill grinding machine of the invention as above described is of small size to be installed on a bench, it has many practical advantages in that re-grinding of the top end of the drill can be performed accurately with high precision so as to reproduce the edge sharpness, of the the finish machined metal of the drill is good and the efficiency is improved, the handling is significantly simple so that a person who is not a skilled worker can use the grinding machine easily without mistake, and the grinding of the drill can be automatically performed by only inserting and fixing the drill in the vertical direction, resulting in great convenience.

DESCRIPTION OF THE PREFERRED EMBODIMENTS

Figure 1:
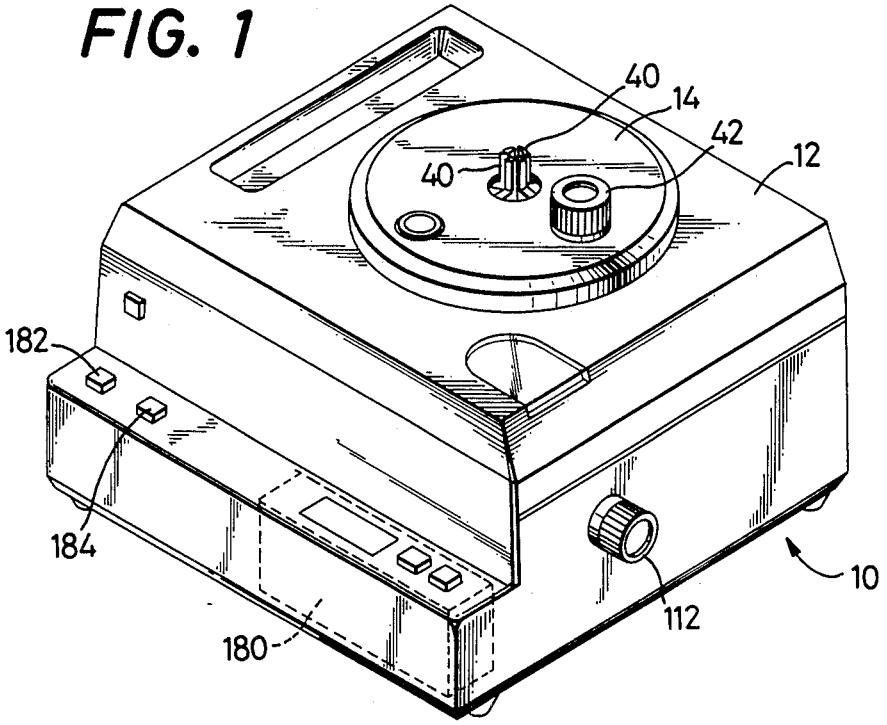
FIG. 1 is a perspective view of a small-sized drill grinding machine as an embodiment of the invention.
Figure 2:
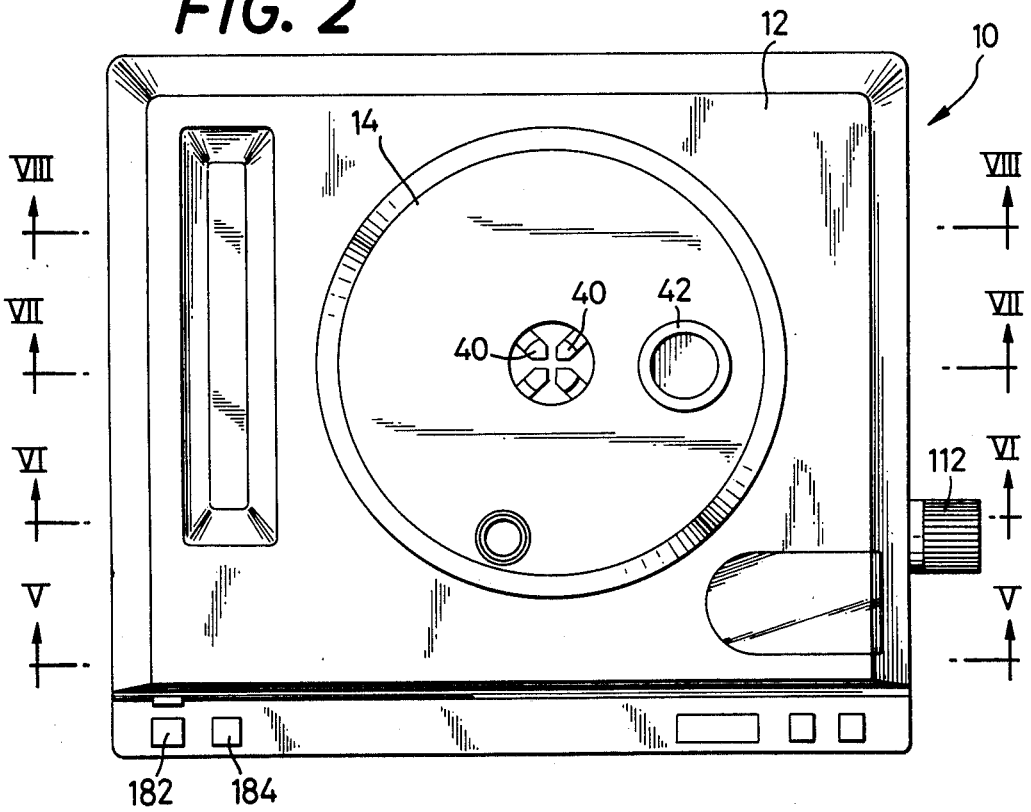
FIG. 2 is a plan view of the drill grinding machine in FIG. 1.
Figure 7:
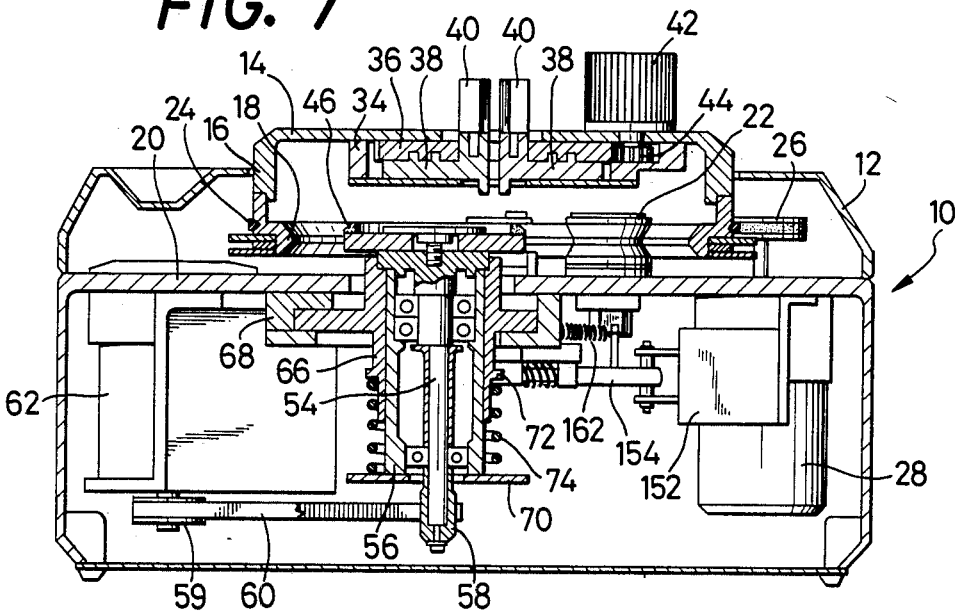
FIG. 7 is a longitudinal sectional view taken along the section VII—VII indicated in FIG. 2.
Figure 8:
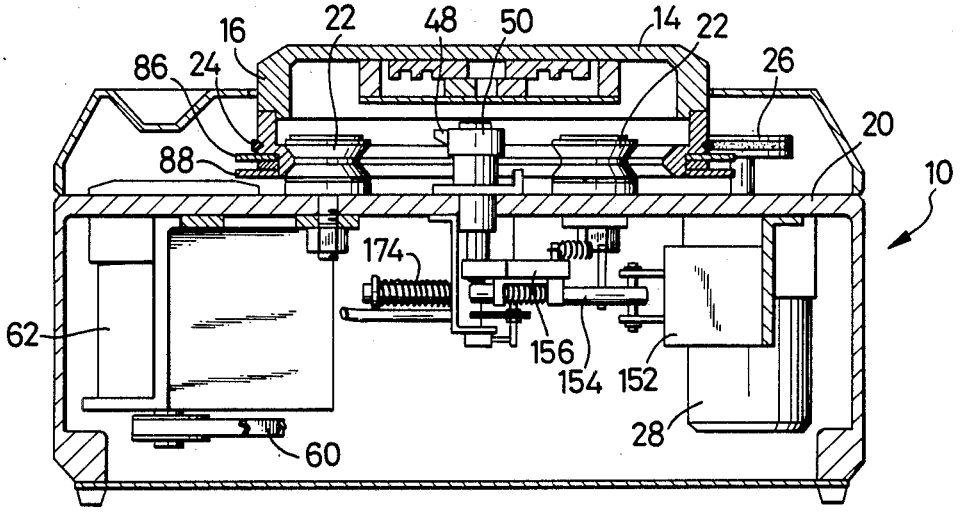
FIG. 8 is a longitudinal sectional view taken along the section VIII—VIII indicated in FIG. 2.

In FIG. 1, reference numeral 19 designates a casing, and a detachable top cover plate 12 is provided at the center with a circular hole through which a turntable 14 is exposed. As shown in FIG. 7, the turntable 14 is formed of a shallow cylinder with a top, and a support projection 18 is provided at a lower portion of the surrounding (cylindrical) wall 16 of the turntable 14. As shown in FIG. 8, the support projection 18 is loosely ritted to V-grooves of support rollers 22 spaced at nearly regular intervals from each other on a top plate 20 of the casing 1, whereby the turntable 14 as a whole is supported while being rotatable around its vertical axis. The surrounding wall 16 of the turntable 14 is provided with a belt groove on which a V-belt 24 is wrapped. The V-belt 24 is wrapped also around a pulley 26 arranged to nearly the same level as that of the belt groove. The pulley 26 is rotated by a table drive motor 28 fixedly installed within the casing 10, whereby the turntable is driven to rotate. Thus in this embodiment, a table drive device is constituted by the table drive motor 28, the pulley 26 and the V-belt 24.

Figure 3:
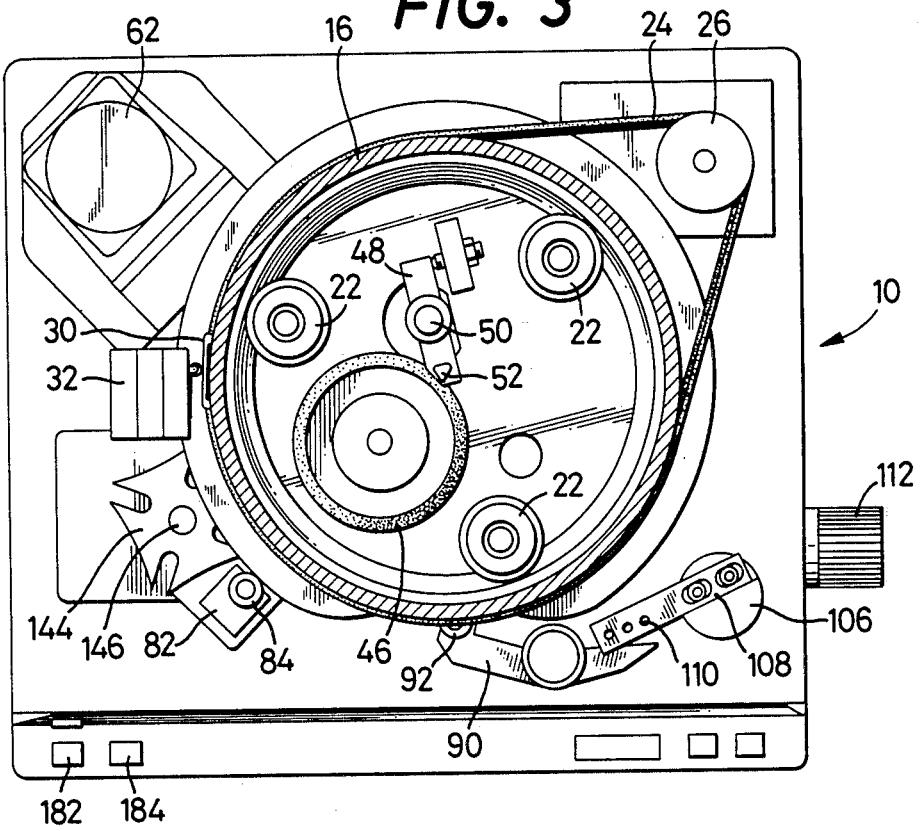
FIG. 3 is a plan view partly in section of the drill grinding machine after removing the top cover plate.

As shown in FIG. 3, a dog 30 is fixed to the outside of the surrounding wall 16 of the turntable 14, and a limit switch 32 is fixedly installed on the top plate 20 and pushed and operated by the dog 30. The dog 30 and the limit switch 32 constitute a table rotational speed detecting device to detect the rotational speed of the turntable 14. This detecting device can also serve as a grinding wheel displacement amount device, as indicated by the further description in the following.

A pawl support member 34 and a scroll gear 36 are arranged at the rear side of the turntable 14 (refer to FIG. 7). The pawl support member 34 is provided with four grooves in which four pawls 38 are held.

An auxiliary pawl 40 is attached to one end of each pawl 38 and projects upward from a drill attaching hole on the center of the turn table 14. The auxiliary pawl 40 may be omitted when the drill is large in diameter and length. The pawl 38 has a projection which is projected into a spiral groove formed at the lower side of the scroll gear 36. When the scroll gear 36 is rotated, the guide action of the spiral groove and the projection of the pawl 38 moves the pawl 38 and the auxiliary pawl 40 to be expanded or contracted. The scroll gear 36 is meshed with a gear 44 fixedly installed to a chuck handle 42 and rotated by the operating force applied to the handle 42.

On the lower side of the chuck device composed of the pawls 38, the scroll gear 36 and the handle 42, a grinding wheel 46 and a drill stopper 48 are arranged (refer to FIG. 3). The drill stopper 48 has a cutting edge contacting part 52 which is rotatable around a shaft 50 journaled vertically to the top plate 20. The cutting edge contacting part 52 abuts on the cutting edge at the end of the drill which is the top end of the drill (i.e., for drilling), whereby the rotational angular position of the drill is defined. The shaft 50 is rotated counterclockwise in FIG. 3, so that during the grinding of the drill the drill stopper 48 is driven back to a position where the cutting edge contacting part 52 does not interfere with the drill cutting edge.

Figure 4:
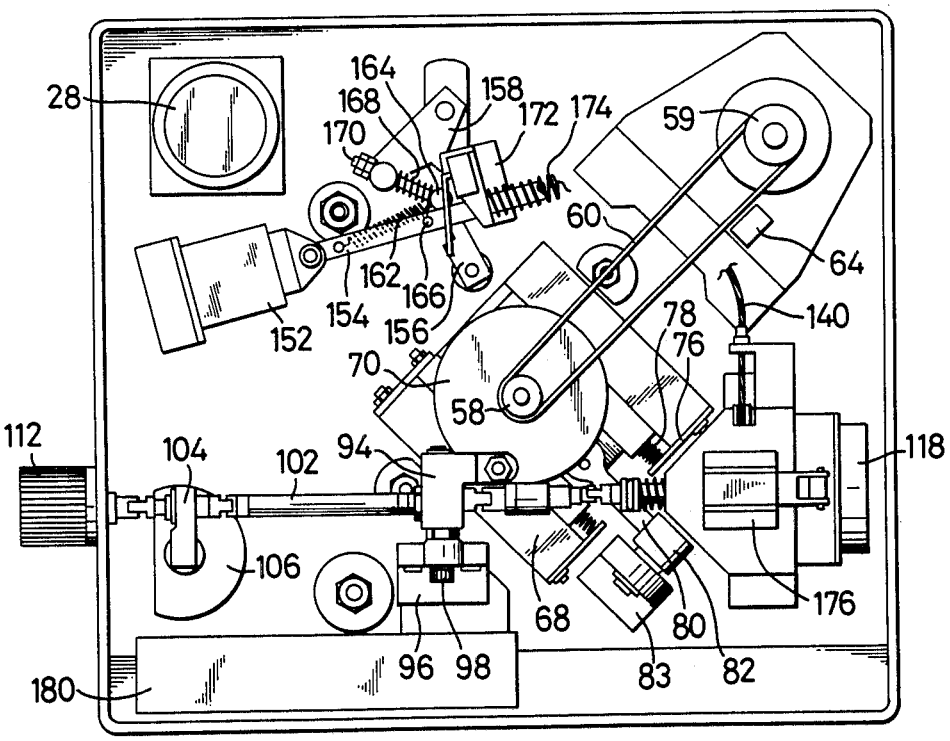
FIG. 4 is a plan view of the drill grinding machine illustrating an inner mechanism after removing the bottom cover plate.

The grinding wheel 46 is of disc shape and is preferably made of diamond (may also be made of cubic boron nitride, etc.), and the axial center (second axial center) of the grinding wheel shaft 54 is arranged in parallel to the rotational axial center of the turntable 14 but is shifted in the perpendicular direction thereto is the position shown in FIG. 3. The grinding wheel 46 is rotatably supported by a quill (first support member) 56 (refer to FIGS. 6, 7) which is movable relatively in the axial direction of the grinding wheel 46 (hereinafter referred to as "vertical direction"). A bottom end portion projecting downward from the quill 56 is connected through pulleys 58, 59 and a flat belt 60 to a grinding wheel drive motor 62 fixed within the casing. The belt 60 is provided with a mark representing a portion to be detected, and a photosensor 64 attached to lower surface of the top plate 20 is arranged near the belt 60 as shown in FIG. 4, so that the passing of the mark is detected by the photosensor 64. In other words, the rotational speed of the belt 60 is detected, and thereby the rotational speed of the grinding wheel 46 is detected indirectly.

Figure 5:
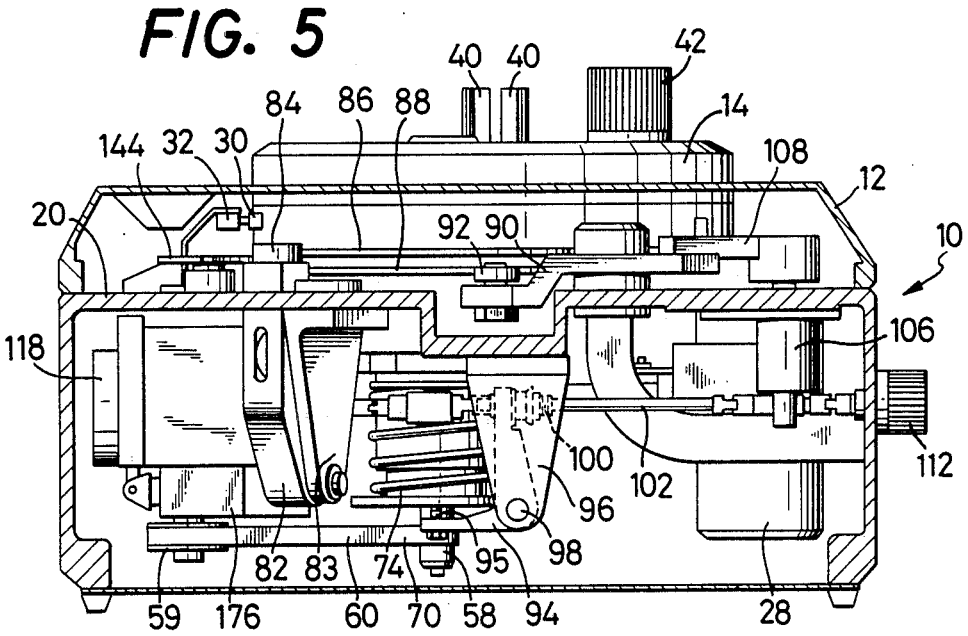
FIG. 5 is a longitudinal sectional view taken along the section V—V of FIG. 2.

The quill 56 is slidably supported in the vertical direction by a spindle housing (second support member) 66. The spindle housing 66 is slidably supported in the horizontal direction perpendicular to the axial center of the grinding wheel 46, i.e. perpendicular to the rotational axial center of the turntable 14, by a support rail (third support member) 68 fixed to the bottom surface of the top plate 20 as shown in FIG. 4. Thus the grinding wheel 46 is movable in both the vertical and horizontal directions by the grinding wheel support device including the quill 56, the spindle housing 66 and the rail 68. The quill 56 is normally biased downward by a compression coil spring 74 interposed between a locking plate 70 at one end of the quill 56 and a locking projection 72 of the spindle housing 66. As shown in FIG. 4, the spindle housing 66 is biased towards the axial center of the turntable 14, i.e. toward the drill axial center, by a spring 78 interposed between a pressure plate 76 fixed to the rail 68 and the spindle housing 66. One end of a rod 80 (FIG. 4) is connected to the housing 66, and other end of the rod 80 is connected to intermediate portion of a horizontal lever 82 shown in FIG. 5. The horizontal lever 82 has a bottom end portion rotatably supported by a bracket 83 fixed to the top plate 20, and a top end portion of the horizontal lever 82 is projected above the top plate 20. The projected top end portion is provided with a driven roller 84 as a second follower. As shown in FIG. 3, the driven roller 84 is contacted with a horizontal cam (second cam) 86 fixed to the surrounding wall 16 of the turn table 14. In addition to the horizontal cam 86, a vertical cam (first cam) 88 is also fixed to the surrounding wall 16 of the turn table 14. A driven roller 92 as a first follower fixed to a rocking lever 90 as hereinafter described is contacted with the horizontal cam 86.

A grinding wheel drive lever 94 rotatably supported around a shaft 98 perpendicular to the grinding wheel axial center by a bracket 96 (refer to FIG. 5) is arranged near the support device. An abutting bolt 95 is fixed to one end of the grinding wheel drive lever 94 and contacted with the locking plate 70 of the quill 56, and a threaded portion 100 is provided at the other end of the grinding wheel drive lever 94 and threadedly engaged with a first transmission shaft 102. One end of the first transmission shaft 102 is connected to the top end portion of a rotatable arm 104 as shown in FIG. 4, and pulled in the axial direction by the rotational movement of the arm 104. The bottom end portion of the rotatable arm 104 is fixed to a vertical shaft 106 (refer to FIG. 5), and the top end of the vertical shaft 106 projects upward above the top plate 20 and a rocking arm 108 is fixed to the top end (refer to FIG. 3 and FIG. 5). A plurality of pin holes 110 are formed on the arm 108, and one of the holes 110 is selected and a transmission pin is inserted in the selected hole. One arm of the rocking lever 90 adjacent to the transmission pin is engaged with the transmission pin. The driven roller 92 as hereinbefore described is fixed to other arm of the rocking lever 90 and contacted with the vertical cam 88 fixed to the turntable 14. When the turntable 14 is rotated, the driven roller 92 is pushed and the movement of the driven roller 92 is transmitted through the rocking lever 90 and the vertical lever 106 to the first transmission shaft 102 which in turn is pulled to the right in FIG. 5 and FIG. 6. If the position of the engaging pin is varied, the contacting point between the rocking lever 90 and the rocking arm 108 is varied and also the amount of rotation of the arm 108 is varied, whereby the thickness of the drill as hereinafter described can be compensated for.

Figure 6:
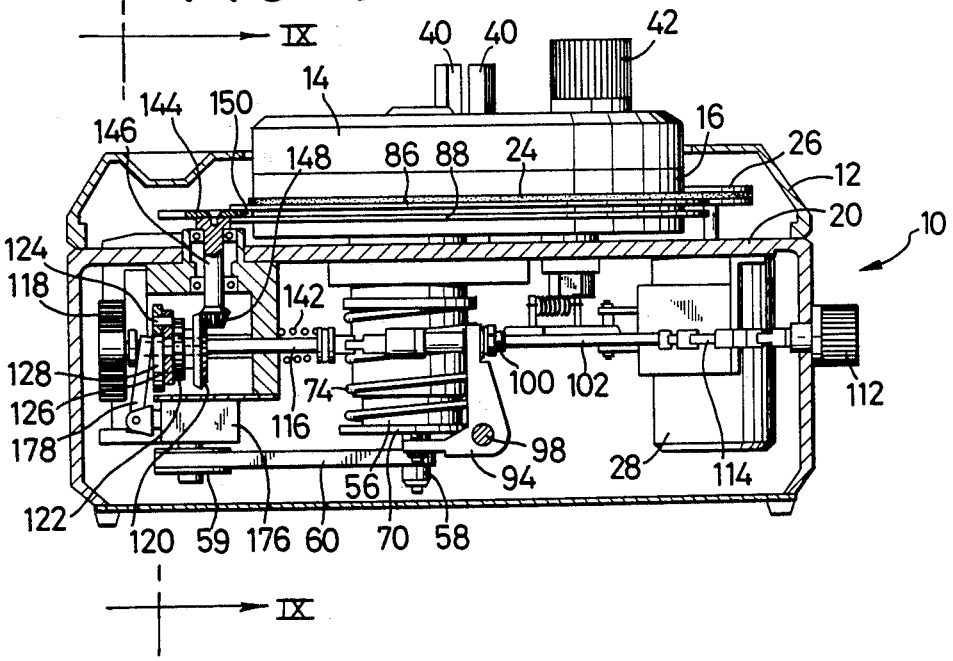
FIG. 6 is a longitudinal sectional view taken along the section VI—VI indicated in FIG. 2.

As shown in FIG. 6, the first transmission shaft 102 is connected also through a connecting rod 114 to a grinding wheel correction (displacement) handle 112 fixed to a lateral surface of the casing 10, and pulled to the right by the rotational operation of the handle 112.

Figure 9:
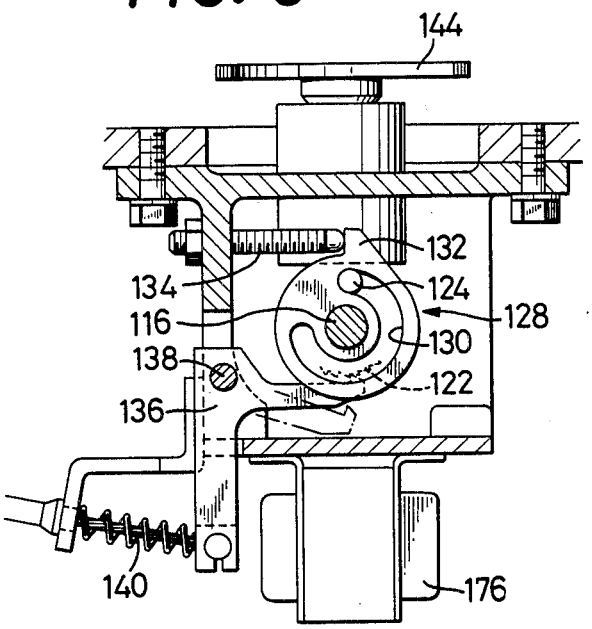
FIG. 9 is a longitudinal sectional view taken along the section IX—IX indicated in FIG. 6.

A second transmission shaft 116 is connected to the other end of the first transmission shaft 102 so that it cannot be rotated relatively to the first transmission shaft 102 but so that it can be moved relatively thereto in the axial direction. One end of a spiral spring 118 is fixed to one end of the second transmission shaft 116. When the second transmission shaft 116 is rotated so as to rotate the grinding wheel drive lever 94 clockwise in FIG. 6, the elastic force is stored in the spiral spring 118. A bevel gear 120, a ratchet member 122, and a disc member 126 with a pin 124 are connected to the second transmission shaft 116 by a key and rotated integrally with the second transmission shaft 116. The pin 124 of the disc member 126 is fitted within a groove 130 on a circular arc of an intermediate member 128 which is rotatable relative to the second transmission shaft 116. When the second transmission shaft 116 is rotated, the pin 124 is moved along the groove 130 so as to allow the relative rotation between the second transmission shaft 116 and the intermediate member 128. As shown in FIG. 9, the intermediate member 128 is provided with a projection 132 which abuts on the top end of the stopper bolt 134. The pin 124 and the stopper bolt 134 constitute a stopper member to define the original position of the second transmission shaft 116, and when both are contacted indirectly through the intermediate member 128, the rotation of the transmission shaft 116 in one direction is inhibited.

As shown in FIG. 9, the ratchet member 122 is provided with a plurality of engaging teeth, and a pawl member 136 is engaged with one engaging tooth. The pawl member 136 and the ratchet member 122 act to inhibit the rotation of the second transmission shaft 116 to rotate the grinding wheel drive lever 94 counterclockwise in FIG. 6. As shown in FIG. 9, the pawl member 136 is rotatable around a shaft 138. A cable 140 is connected to one end thereof, and when the cable 140 is pulled, the engagement between the pawl member 136 and the engaging teeth of the ratchet member 122 is released.

The bevel gear 120 meshes with a bevel gear 148 fixed to a rotational shaft 146 of a Geneva wheel 144 based on a biasing force of a coil spring 142. The Geneva wheel 144 is rotatably arranged near the turntable 14. An engaging pin 150 is fixed between the horizontal cam 86 and the vertical cam 88 in the surrounding wall 16 of the turntable 14, so that the engaging pin 150 is engaged with the Geneva wheel 144.

As shown in FIG. 4, a solenoid 152 to release the locking mechanism including the ratchet member 122 and the pawl member 136 is installed within the casing 10. The cable 140 is connected to the top end portion of a traveling shaft 154 of the solenoid 152, and if the traveling shaft 154 is driven back the cable 140 is pulled. The traveling shaft 154 is connected to a drill stopper lever 156 coupled with the drill stopper shaft 50 and also to a table stopper lever 158 coupled with a table stopper (not shown). The drill stopper lever 156 is connected through a coil spring 162 and a pin 164. When the traveling shaft 154 is driven back, the pulling action of the spring 162 rotates the drill stopper lever 156 around the drill stopper shaft 50 so that the cutting edge contacting part 52 is driven back. When the traveling shaft 154 is driven forward, the drill stopper lever 156 is pushed by a pin 166 and rotated to the acting position (locking position). The table stopper lever 158 is operatively connected through a coil spring 168 and a rod 170 to the traveling shaft 154, so that the table stopper lever 158 is rotated to the non-acting position when the traveling shaft 154 is driven back and to the stopper acting position when the traveling shaft 154 is driven forward. The traveling shaft 154 is normally biased forward by a coil spring 174 pressing at its left end against a plate 172 fixed to the casing 10.

A solenoid 176 to release the engagement between the bevel gears 120 and 148 is also installed within the casing 10. A traveling shaft of the solenoid 176 is connected to a lever 178 which in turn is connected to the second transmission shaft 116.

Figure 13:
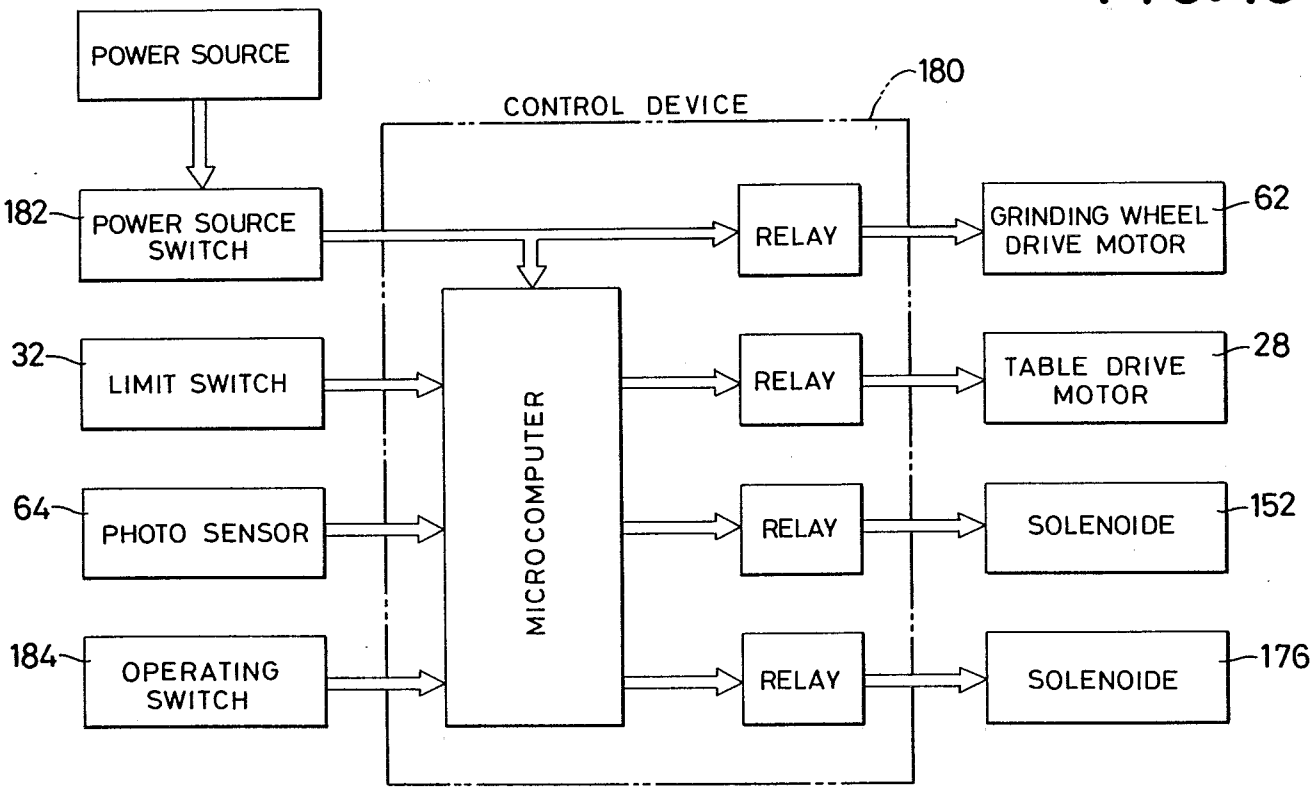
FIG. 13 is a block diagram illustrating relation between the control device and the detecting device of the drill grinding machine shown in FIGS. 1 through 9 and the control object.

As shown in FIG. 1, a control device 180 including a microcomputer, a power source switch 182 and an operating switch 184 are arranged on front of the casing 10. As shown in FIG. 13, signals from the power source switch 182, the operating switch 184, a limit switch 32 and a photo sensor 64 to detect the rotational speed of the grinding wheel are input to the control device 180. The control device 180 controls the solenoids 152, 178 and the motors 28, 62.

Operation of the drill grinding machine will now be described together with the procedure for the drill grinding operation.

First, if the power source switch 182 is pushed, the grinding wheel drive motor 62 is operated and the solenoid 152 is energized, and thereby the traveling shaft 154 is driven back and the drill stopper 48 is rotated to the acting position. In this state, the drill is inserted vertically in the drill attaching hole at the center of the turntable so that the top end of the drill abuts on the drill stopper 48. If the drill is slightly rotated by hand in this state, the cutting edge at the top end of the drill is contacted with the cutting edge contacting part 52, whereby the rotational angular position of the drill is determined. If the chuck handle 42 is operated for rotation, the scroll gear 36 is rotated and the pawls 38 are moved and the drill is grasped and fixed from four directions.

A number for determining the drill grinding amount (specifically the number of revolutions of the table for rough machining) is input, and then the operating switch 184 is pushed. The solenoid 152 is demagnetized and the traveling shaft 154 is driven forward, whereby the cutting edge contacting part 52 of the drill stopper 48 is driven back to the position where it does not interfere with the cutting edge of the drill, and also the pawl member 136 is engaged with the engaging teeth of the ratchet member 122. Then the table drive motor 28 is operated according to command from the control device 180, and the turntable 14 is driven to rotate.

When the table 14 is rotated, the vertical cam 88 and the horizontal cam 86 also rotate. Since the horizontal cam 86 is rotated, the horizontal lever 82 contacted through the driven roller 84 to the cam 86 is rotated and the movement is transmitted through the rod 80 to the spindle housing 66, whereby the grinding wheel 46 is reciprocated in the horizontal direction.

Also, since the vertical cam 88 is rotated, the rocking lever 90 contacted through the driven roller 92 to the vertical cam 88 is rocked, and the movement is converted into the rotational movement of the arm 108, the vertical shaft 106 and the rotatable arm 104, whereby the first transmission shaft 102 is reciprocated in the axial direction. Since the first transmission shaft 102 is reciprocated, the grinding wheel drive lever 94 is rotated around the shaft 98, whereby the grinding wheel 46 is reciprocated in the vertical direction.

Since the rotational angle of the horizontal cam 86 and the vertical cam 88 is varied in correspondence to the rotation of the table 14, the grinding wheel 46 is moved in a predetermined manner in both the horizontal and vertical directions which motion is repeated twice during each revolution of the drill.

Figure 11:
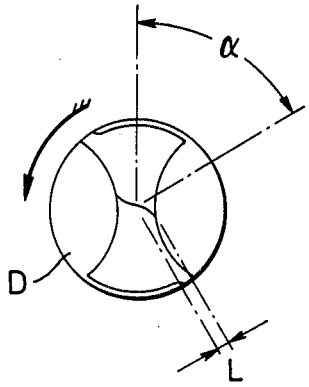
FIG. 11 and FIG. 12 are a plan view and a sectional view of a drill cutting edge respectively illustrating the action of the small-sized drill grinding machine.
Figure 12:
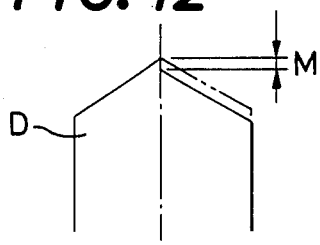

This is because the grinding wheel 46 is displaced in the horizontal direction by distance L while the drill D is rotated by $\alpha$ degrees as shown in FIG. 11, and the grinding wheel 46 at the same time is displaced downward by distance M as shown in FIG. 12, whereby the relief angle from the cutting edge at the top end of the drill and the thinning of the chisel part of the drill are provided simultaneously. In order to perform similar grinding for the two cutting edges at the top end of the drill, the grinding wheel 46 continuously repeats the same movement two times during each revolution of the drill.

When the turntable 14 is rotated, the engaging pin 150 is engaged with the Geneva wheel 144 at a certain angular position. If the table 14 is further rotated, the Geneva wheel 144 is rotated together therewith and then the engaging pin 150 is detached from the Geneva wheel 144 at a definite position whereby the rotation of the Geneva wheel 144 is stopped. The rotation of the Geneva wheel 144 is transmitted through the bevel gears 148 and 120 to the second transmission shaft 116 which is rotated together with the first transmission shaft 102. Since the grinding wheel drive lever 94 is threadedly engaged with the first transmission shaft 102, the grinding wheel drive lever 94 is rotated by a feed action often relatively rotating the reeds whereby the quill 56 is elevated by a definite amount against the biasing force of the coil spring 74. The grinding wheel 46 is elevated by an amount corresponding to the amount of revolution of the Geneva wheel 144 is intermittently rotated with each revolution of the turn-table 14, whereby the effective infeed of the drill is increased during the repeated grindings of the same drill according to the above number that was input. Thus, the grinding wheel 46 is elevated by a prescribed amount during the rotations of the turntable 14 by the set number of revolutions that was input. Then, the solenoid 176 is operated according to command from the control device 180, whereby the bevel gears 120 and 148 are separated from each other against the biasing force of the spring 142. That is, the operative connection between the Geneva wheel 144 and the second transmission shaft 116 is then broken by letting out the clutch. After thusly breaking the connection between the bevel gears 120 and 148, the grinding wheel 46 is not elevated, but rather only the rotation of the drill is completed. When the number of revolutions attains the prescribed value (e.g. two times), a command is issued from the control device 180 so as to stop the table drive motor 28 and at the same time to energize the solenoid 152. The drill stopper 48 is returned to the acting position, and the turn table 14 is stopped at a prescribed position by means of action of the table stopper lever 158. At the same time, the engagement between the pawl member 136 and the ratchet member 122 is released. Thereby the second transmission shaft 116 and the first transmission shaft 102 are rotated in the reverse direction, due to the elastic force in the spiral spring 118. The reverse rotation is stopped when the projection 132 of the intermediate member 123 contacts the stopper bolt 134 and the pin 124 comes to the end of the circular arc groove 130 illustrated in FIG. 9. The intermediate member 128 is rotatable relatively to the second transmission shaft 116 by the angular range defined by the length of the circular arc groove 130 (about 270 degrees in the illustrated embodiment). The intermediate member 128 can be rotated by an amount slightly less than one revolution without interfering with the stopper bolt 134. Consequently, the second transmission shaft 116 can be rotated by one revolution or more in spite of the existence of the stopper bolt 134. This is because the intermediate member 128 is interposed between the disc member 126 fixed to the second transmission shaft 116 and the stopper bolt 134.

When the rough machining and the final machining for the drill are finished, the drill is exchanged and the grinding for a new drill is performed again.

If an abnormal rotational speed of the grinding wheel 46 is detected by the sensor 64 (for example, reduction of the rotational speed by 20% or more), the turntable 14 is automatically stopped according to command from the control device 180. Such abnormal rotational speed of the grinding wheel 46 can arise for instance if the flat belt 60 is elongated on account of fatigue and slips between the pulleys 58, 59, if a load greater than prescribed value is applied to the grinding wheel drive motor 62, of if the grinding wheel drive motor 62 is overheated and the rotational speed is decreased.

Thus in the illustrated embodiment, since the grinding wheel 46 is automatically elevated corresponding to a preset number of revolutions of the turntable 14, and the elevating movement is automatically stopped at a desired position at the end of the number of revolutions, any person can accurately perform re-grinding and thinning of a drill by a required amount without necessitating any skill.

The bevel gears 120, 148 constituting a part of the grinding wheel serve also as a part of the clutch mechanism to perform the elevations movement and the interruption between the Geneva wheel 144, the second transmission shaft 116 and the grinding wheel 46. If the grinding wheel 46 is made of diamond, little abrasion thereof occurs and the dressing for reshaping the grinding wheel becomes unnecessary and the constitution for the device of the present invention is simple.

Figure 10:
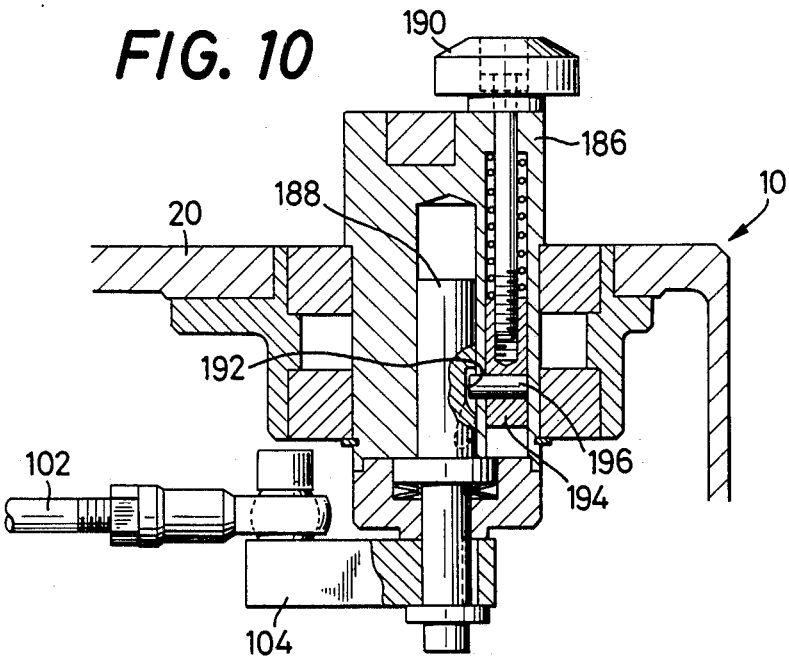
FIG. 10 is an enlarged sectional view of a grinding wheel correcting handle and peripheral portion thereof in a small-sized drill grinding machine as another embodiment of the invention.

The grinding wheel correction handle 112 shown in the respective figures above may also be installed on the upper surface of the top plate 20 of the casing 10 as indicated in FIG. 10. In the embodiment of FIG. 10, a rotary body 188 is enclosed within a vertical shaft 186, and is rotated by the action of a spiral groove 192 provided in the rotary body 188 and a pin 196 provided in a slider 194, based on operation of a grinding wheel correction handle 190. The rotational movement of the rotary body 188 is transmitted to the rotatable arm 104 and the first transmission shaft 102 is pulled, whereby the grinding wheel drive lever 94 is rotated and the position of the grinding wheel 46 is corrected.

Although embodiments of the present invention may be constituted as described above, the invention is not limited thereto, and various modifications regarding structure may be made within the scope of claims of the invention.

What is claimed is:

1. A small-shaped drill grinding machine comprising:

(a) a casing;

(b) a turntable having a drill attaching hole at the center and which is supported by said casing and rotatable around a first axial center passing through said drill attaching hole, said turntable having an outer circumferential part;

(c) a table drive device for driving said turntable to rotate;

(d) a chuck device having pawls provided at the center of said turntable which are movable perpendicularly to the first axial center, for grasping the drill using the pawls so that the axial center of the drill coincides with the first axial center;

(e) a grinding wheel having a rotary shaft which is rotatable around a second axial center shifted from but parallel to the first axial center, for grinding a cutting edge at the top end of the drill rotating together with the turntable;

(f) a grinding wheel drive device for driving said grinding wheel to rotate;

(g) a grinding wheel support device provided with a first support member to rotatably support said grinding wheel, a second support member to support said first support member while being movable relative thereto along the direction of the second axial center, and a third support member to support said second support member while being movable relative thereto in a direction perpendicular to the second axial center, for supporting the grinding wheel while allowing said grinding wheel to move to the drill axial center;

(h) a grinding wheel drive lever installed near said grinding wheel support device to be rotatable around a third axial center which is perpendicular to the second axial center when a first end thereof is engaged with the second support member, said grinding wheel driver lever having a threaded portion at a second end thereof;

(i) a first transmission shaft threadedly engaged with the threaded portion of said second end of said grinding wheel drive lever;

(j) a second transmission shaft connected to said first transmission shaft so that it cannot be rotated relative to said first transmission drive shaft but so that it can be moved axially relative to said first transmission drive shaft;

(k) first and second cams installed to contact said outer circumferential part of the turntable;

(l) a first grinding wheel moving mechanism having a first follower to follow said first cam, for converting the movement of said first follower into movement of the first transmission shaft in its axial direction, for correspondingly rotating the grinding wheel drive lever and moving the grinding wheel forward and backward in the drill axial direction, as a result of said first end of the lever being engaged with the second support member and the threaded engagement of the second end of the grinding wheel drive lever with said first transmission shaft;

(m) a second grinding wheel moving mechanism having a second follower to follow said second cam, for converting the movement of said second follower into the relative movement of the second support member perpendicularly to the drill axial center;

(n) an intermittent rotation mechanism including a rotor installed near the turntable and an engaging piece provided on the turntable and rotatable integrally therewith, wherein said rotor is rotated by a certain amount for each revolution of the turntable based on the engagement of said engaging piece with the rotor end during a predetermined portion of each rotation of the turntable; and (o) a grinding wheel displacement mechanism for converting the rotation of said rotor into the rotation of the second transmission shaft, as a result of which the grinding wheel drive lever threadedly engaged with the first transmission shaft is correspondingly rotated, and the grinding wheel is correspondingly displaced in parallel to the drill axial center to effectively provide drill infeed.

2. A drill grinding machine as set forth in claim 1, further including a grinding wheel displacement amount device for providing a setting corresponding to setting said grinding wheel, and a control device in communication with said grinding wheel displacement amount setting device, wherein when the grinding wheel is displaced by the prescribed amount, the control device stops the displacing by said grinding wheel displacement mechanism.

3. A drill grinding machine as set forth in claim 1, comprising a grinding wheel rotational speed detecting device for detecting when the detected rotational speed is outside of a set range and for outputting a respective signal, wherein said control device stops said grinding wheel drive device based on said signal from said detecting device.

4. A drill grinding machine as set forth in claim 3, wherein said grinding wheel drive device includes a motor, and a transmission belt stretched between a shaft of said motor and the rotary shaft of the grinding wheel, said bolt having a symbol attached thereto, and said grinding wheel rotational speed detecting device includes a photosensor for optically detecting said symbol on the belt when it passes the photosensor.

5. A drill grinding machine as set forth in claim 1, comprising:

a member fixed to said casing, a locking mechanism installed between the second transmission shaft and the fixed member for allowing the forward rotation of the second transmission shaft so that the second transmission shaft displaces the grinding wheel to effectively infeed said drill with respect to said grinding wheel as a result of rotation of the grinding wheel drive lever, and for inhibiting the reverse rotation of the second transmission shaft, a spiral spring with one end fixed to the second transmission shaft for storing the elastic force during the forward rotation of the second transmission shaft, a release mechanism for releasing the locking action of the locking mechanism, and a control device, wherein when the grinding wheel is displaced by a prescribed amount, the control device actuates said release mechanism based on the signal from the grinding wheel displacement amount detecting device.

6. A drill grinding device as set forth in claim 5, wherein stopper parts are installed between the second transmission shaft and the fixed member, and the original position of the second transmission shaft is defined by a predetermined one of direct and indirect contact of said stopper parts.

7. A drill grinding machine as set forth in claim 6, wherein an indirect member is arranged between the two stopper parts and rotatable relatively only within a definite angular range to the second transmission shaft, and the two stopper parts are indirectly contacted through said indirect member.

8. A drill grinding machine as set forth in claim 5, wherein said locking mechanism has a ratchet member fixed to the second transmission shaft so as not to be rotatable relatively therewith, said ratchet member to have a plurality of engaging teeth on an outer circumferential portion thereof, a pawl member engaged with the engaging teeth, and a spring member for biasing the pawl member to be engaged with the engaging teeth, and said release mechanism has an actuator for separating the pawl member from the ratchet member against the biasing force of the spring member.

9. A drill grinding machine as set forth in claim 1, wherein a clutch device is installed between said rotor and said grinding wheel drive lever, so that a connection between the rotor and the grinding wheel drive lever is interrupted by said clutch device.

10. A drill grinding machine as set forth in claim 9, wherein said clutch device comprises a first clutch member which is integrally rotated with the rotor, a second clutch member which is integrally rotated with the second transmission shaft, and an actuator to perform connection and separation between the first clutch member and the second clutch member.

11. A drill grinding machine as set forth in claim 10, wherein said grinding wheel displacement mechanism comprises a rotary shaft for said rotor, to integrally rotate with said rotor, a first bevel gear fixedly installed on the rotary shaft of the rotor, and a second bevel gear fixedly installed on the second transmission shaft and which meshes with said first bevel gear for converting the rotational movement of the rotor into the rotational movement of the second transmission shaft, and the first and second bevel gears serve also as said first and second clutch members of the clutch mechanism respectively.

12. A drill grinding machine as set forth in claim 1, wherein said grinding wheel displacement mechanism comprises a first bevel gear fixedly installed on a rotary shaft of the rotor, and a second bevel gear is fixedly installed on the second transmission shaft and meshes with said first bevel gear for converting the rotational movement of the rotor into the rotational movement of the second transmission shaft.

13. A drill grinding machine as set forth in claim 1, wherein said rotor of the intermittent movement mechanism is a Geneva wheel, and said engaging piece is an engaging pin fixedly installed on the turntable, and the engaging pin enters in an engaging groove of the Geneva wheel and goes out of the engaging groove, whereby the Geneva wheel is rotated intermittently.

14. A drill grinding machine as set forth in claim 1, comprising a table rotational speed detecting device including a dog fixedly installed to outer circumferential portion of the turn table, and a limit switch installed at a definite position for generating signal in response to pushing by said dog, and said detecting device also serves as the grinding wheel displacement amount detecting device.

15. A drill grinding machine as set forth in claim 1, wherein an angle is installed on a side surface of the casing for providing displacement correction of the grinding wheel position, wherein the first transmission shaft is connected to the handle, and the rotational operation of the handle moves the first transmission shaft in the axial direction, whereby the grinding wheel drive lever is rotated.

* * * * *